US007258570B2

(12) United States Patent
Asai

(10) Patent No.: US 7,258,570 B2
(45) Date of Patent: Aug. 21, 2007

(54) CONNECTOR FOR FLEXIBLE BOARD

(75) Inventor: Kiyoshi Asai, Shinagawa-ku (JP)

(73) Assignee: SMK Corporation, Tokyo (JP)

( * ) Notice: Subject to any disclaimer, the term of this patent is extended or adjusted under 35 U.S.C. 154(b) by 34 days.

(21) Appl. No.: 11/160,000

(22) Filed: Jun. 23, 2005

(65) Prior Publication Data

US 2005/0287866 A1 Dec. 29, 2005

(30) Foreign Application Priority Data

Jun. 25, 2004 (JP) ..... 2004-187280

(51) Int. Cl.
*H01R 12/24* (2006.01)

(52) U.S. Cl. ..... 439/495; 439/260; 439/497

(58) Field of Classification Search ..... 439/495, 439/493, 67, 492, 497, 260
See application file for complete search history.

(56) References Cited

U.S. PATENT DOCUMENTS

| | | | | |
|---|---|---|---|---|
| 4,944,690 | A * | 7/1990 | Imai | 439/492 |
| 5,462,441 | A * | 10/1995 | Renn et al. | 439/67 |
| 5,800,204 | A * | 9/1998 | Niitsu | 439/495 |
| 5,911,597 | A * | 6/1999 | Oshitani | 439/495 |

FOREIGN PATENT DOCUMENTS

| | | |
|---|---|---|
| JP | 6-86289 | 12/1994 |
| JP | 7-18386 | 3/1995 |
| JP | 8-45622 | 2/1996 |
| JP | 9-185977 | 7/1997 |
| JP | 9-199241 | 7/1997 |
| JP | 9-283240 | 10/1997 |
| JP | 2000-100505 | 4/2000 |
| JP | 2001-177206 | 6/2001 |
| JP | 2001-351710 | 12/2001 |
| JP | 2002-50423 | 2/2002 |
| JP | 2002-134861 | 5/2002 |
| JP | 2002-175848 | 6/2002 |
| JP | 2002-190360 | 7/2002 |
| JP | 2002-216880 | 8/2002 |
| JP | 2002-359024 | 12/2002 |
| JP | 2003-36921 | 2/2003 |
| JP | 2003-59560 | 2/2003 |
| JP | 2003-92159 | 3/2003 |
| JP | 2003-317838 | 11/2003 |
| JP | 2004-158280 | 6/2004 |
| JP | 2004-303693 | 10/2004 |
| JP | 2005-5136 | 1/2005 |

* cited by examiner

*Primary Examiner*—Xuong Chung-Trans
(74) *Attorney, Agent, or Firm*—Pearne & Gordon LLP

(57) ABSTRACT

A connector for a flexible board includes a housing integrally formed with a bottom board, side wall portions and a top board, and formed with a board insertion portion that has a laterally extending opening shape disposed between the bottom board and the top board, and a plurality of contacts each integrally formed with a mounting piece portion and a resilient contact piece portion projecting into the board insertion portion and contacting with the flexible board, the flexible board is contacted with a connected board through the contacts, the top board is formed from a metallic board receiving plate, when the flexible board is inserted into the board insertion portion, the flexible board is held between the board receiving plate and the resilient contact piece portions.

13 Claims, 5 Drawing Sheets

CONNECTOR FOR FLEXIBLE BOARD

BACKGROUND OF THE INVENTION

The present invention relates to a connector for connecting a flexible board such as FPC to a connected board such as a printed circuit board.

Generally, the connector is used for connecting the flexible board such as FPC to a mounted board that is built into an electronic device in such a manner that the flexible board is inserted into the connector and is electrically connected to the mounted board of the electronic device.

For example, as shown in FIG. 7, the connector 1 for the flexible board 2 includes a housing 4 having a board insertion portion 3 into which a terminal portion of the flexible board 2 is inserted and a plurality of contacts 5 held in the housing 4. Resilient contact piece portions 5*a* of the contacts 5 project into the board insertion portion 3 and contact with the terminal portion of the flexible board 2, which is inserted into the board insertion portion 3, so that the flexible board 2 is electrically connected to a connected board 6 through the contacts 5.

The housing 4 made of synthetic resin material is integrally formed with a bottom board 4*a*, wall portions 4*b* that are disposed at a periphery of the bottom board 4*a* and a top board 4*c* that is opposed to the bottom board 4*a* through the wall portions 4*b*. The housing 4 is formed with the board insertion portion 3 that opens to a side surface of the housing 4 in a laterally extending manner, and is disposed between the bottom board 4*a* and the top board 4*c*. *Patent Document* 1:JP-A-2002-359024

However, in the related art described above, stress caused from elastic deformation of the contact (the resilient contact piece portions) affects the top board and the bottom board of the housing through the flexible board and the contact reaction force receiving portion or the like, so that the top board and the bottom board, made of synthetic resin material, are deformed and a suitable contact state thereof may not be maintained. Both of the top board and the bottom board have to be designed to have a certain thickness in order to prevent such deformation, thereby hindering miniaturization (reducing the thickness).

SUMMARY OF THE INVENTION

This invention has been made in view of the above problem of the related art, and an object of the present invention is to provide a connector for a flexible board in which a suitable contact state is maintained and thickness of members constituting a housing can be reduced.

In order to accomplish the above object, a connector for a flexible board of the present invention is characterized by having the following arrangement.

(1) A connector for connecting a flexible board to a connected board comprising:

a housing that is formed with a bottom board, side walls standing at opposite ends of the bottom board, a back wall standing at a back end of the bottom board perpendicular to the side walls, and a board receiving plate that is made of metal and is opposed to the bottom board through the side walls and the back wall;

a board insertion portion that is disposed in the housing and opens to a front side portion of the housing that is opposed to the back wall in a laterally extending manner;

a plurality of contacts each of that is integrally formed with a mounting piece portion that is held in the housing and a resilient contact piece portion that is supported to an end portion of the mounting piece portion and projects into the board insertion portion from a side portion in the housing that is positioned at the bottom board, wherein when the flexible board is inserted into the board insertion portion, the resilient contact portion is resiliently contacted with the flexible board and the flexible board is held between the board receiving plate and the resilient contact portion.

(2) A connector according to (1), wherein the board receiving plate is integrally formed with fixing pieces that are disposed at opposite ends of the board receiving plate in a insertion direction of the flexible board, and the fixing pieces are locked at a bottom portion of the housing and are fixed to fixing patterns formed on the connected board.

(3) A connector according to (1), wherein the bottom board includes an upper surface that faces to the board insertion portion, a step portion that is disposed on the front side portion, and inclination portions that are disposed at opposite sides of the bottom board in a insertion direction of the flexible board, the step portion is continued to the upper surface through the inclination portions, and the board receiving plate is integrally formed with an introduction piece portion that is disposed at a front edge of the board receiving plate positioned at the front side portion in an obliquely upward manner.

(4) A connector according to (3), wherein the housing includes insertion confirmation gaps that are disposed at opposite sides of the introduction piece portion in the insertion direction.

(5) A connector according to (1), wherein the board receiving plate is formed with a reinforcement piece that is bent at a back edge of the board receiving plate opposed to the front side portion of the housing.

(6) A connector according to (1), wherein the flexible board is integrally superposed with a reinforcement plate that is disposed on an upper surface of the flexible board facing to the board receiving plate.

(7) A connector for connecting a flexible board to a connected board comprising:

a housing body that is made of synthetic resin and is formed with a bottom board, side walls standing at opposite ends of the bottom board, and a back wall standing at a back end of the bottom board perpendicular to the side walls, the housing body being adapted to hold the flexible board;

a board receiving plate that is made of metal and is mounted on the housing body, the board receiving plate being opposed to the bottom board through the side walls and the back wall; and a contact that is held in the housing body and is adapted to be contact with the flexible board, wherein when the flexible board is inserted into the housing body, the contact is contacted with the flexible board and the flexible board is held between the board receiving plate and the contact.

(8) A connector according to (7), wherein a plurality of the contacts are held in the housing body and are adapted to be contact with the flexible board.

(9) A connector according to (7), wherein the contact is integrally formed with a mounting piece portion that is held in the housing body and a resilient contact piece portion that projects into the housing body so as to be contacted with the flexible board.

(10) A connector according to (7), wherein the board receiving plate is integrally formed with fixing pieces that are disposed at opposite ends of the board receiving plate in a insertion direction of the flexible board, and the fixing pieces are locked at a bottom portion of the housing body and are fixed to fixing patterns formed on the connected board.

(11) A connector according to (7), wherein the board receiving plate is integrally formed with an introduction piece portion that is disposed at a front edge of the board receiving plate opposed to the back wall in an obliquely upward manner.

(12) A connector according to (11), wherein the bottom board includes an upper surface, a step portion that is disposed on a front side portion of the housing body opposed to the back wall, and inclination portions that are disposed at opposite sides of the bottom board in a insertion direction of the flexible board, and the step portion is continued to the upper surface through the inclination portions.

(13) A connector according to (11), wherein the housing body includes insertion confirmation gaps that are disposed at opposite sides of the introduction piece portion in a insertion direction of the flexible board.

(14) A connector according to (7), wherein the board receiving plate is formed with a reinforcement piece that is bent at a back edge of the board receiving plate according to the back wall.

(15) A connector according to (7), wherein the flexible board is integrally superposed with a reinforcement plate that is disposed on an upper surface of the flexible board facing to the board receiving plate.

According to the invention, the metallic member, having high strength, receives stress caused from the resilient contact piece portions, so that deformation of the top board is prevented. Therefore, thickness of the top board is kept thinner than that of the related connector, which has the top board made of synthetic resin material, and whole of the connector is adapted to be reduced in the thickness.

According to the invention, unfastening of the top board from the housing is prevented, so that the top board receives the stress caused from the resilient contact piece portions in a suitable contact state. Furthermore, the connector obtains a high shield effect by grounding the fixing pattern.

According to the invention, the introduction piece portion introduces the flexible board to the connector, therefore the flexible board is relatively easily inserted into the connector. However, after the insertion, the flexible board is inserted into the connector in a bending manner, so that resistance to force operating in a removing direction of the flexible board is generated, the flexible board is not removed easily, and the suitable contact state is able to be maintained. When the flexible board is removed from the connector, the introduction piece portion introduces the flexible board, therefore the flexible board is removed from the connector easily.

According to the invention, an insertion condition of the flexible board to the connector is identified easily.

According to the invention, the board receiving plate is reinforced, therefore arched deformation of the board receiving plate is prevented.

According to the invention, holding force for the flexible board by the connector is advanced, so that a stable insertion state is obtained. Moreover, the state can be a reference of a check with eyes whether the flexible board is surely inserted into the connector.

DETAIL DESCRIPTION OF PREFERRED EMBODIMENTS

A connector for a flexible board according to the present invention will now be described with reference to the drawings.

Figure 1:
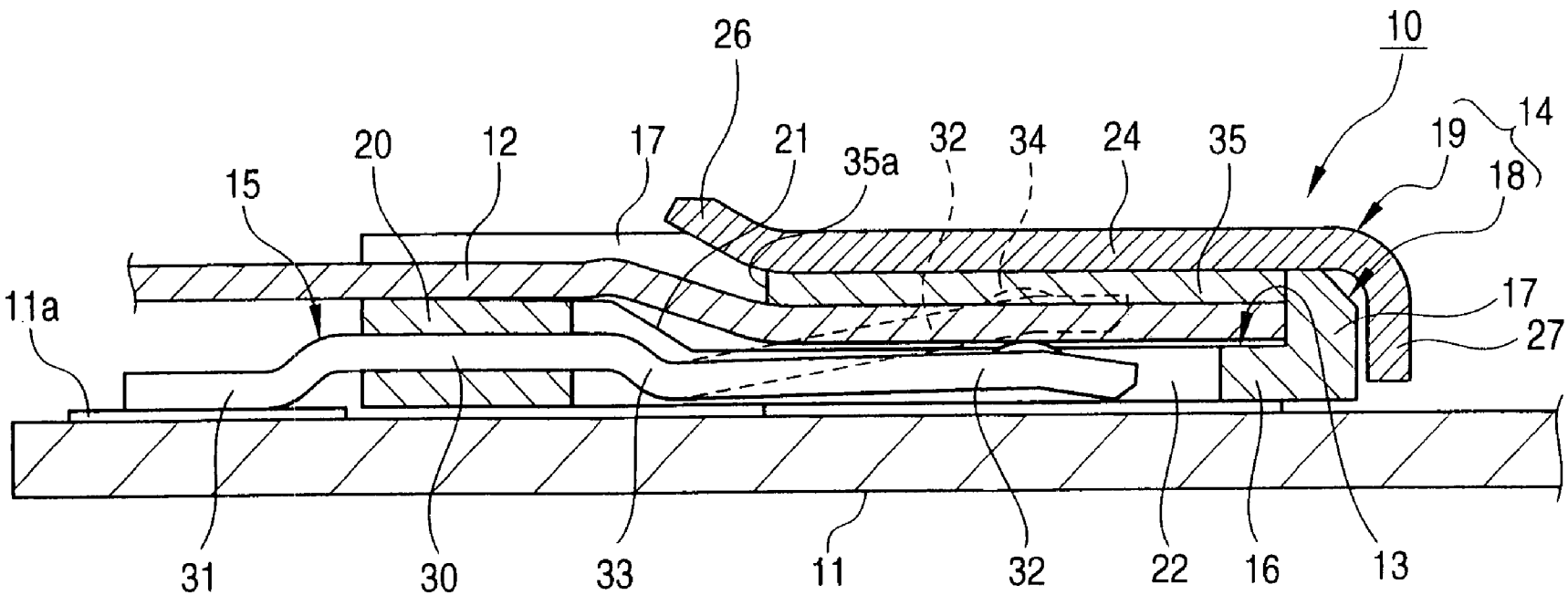
FIG. 1 is a cross-sectional view of a connector for a flexible board, which relates to the present invention, showing an example of using condition thereof.

FIG. 1 shows a state of using the connector. In FIG. 1, reference numbers 10, 11, and 12 show the connector, a connected board that is built into an electronic device or the like, and the flexible board such as FPC, respectively.

Figure 2:
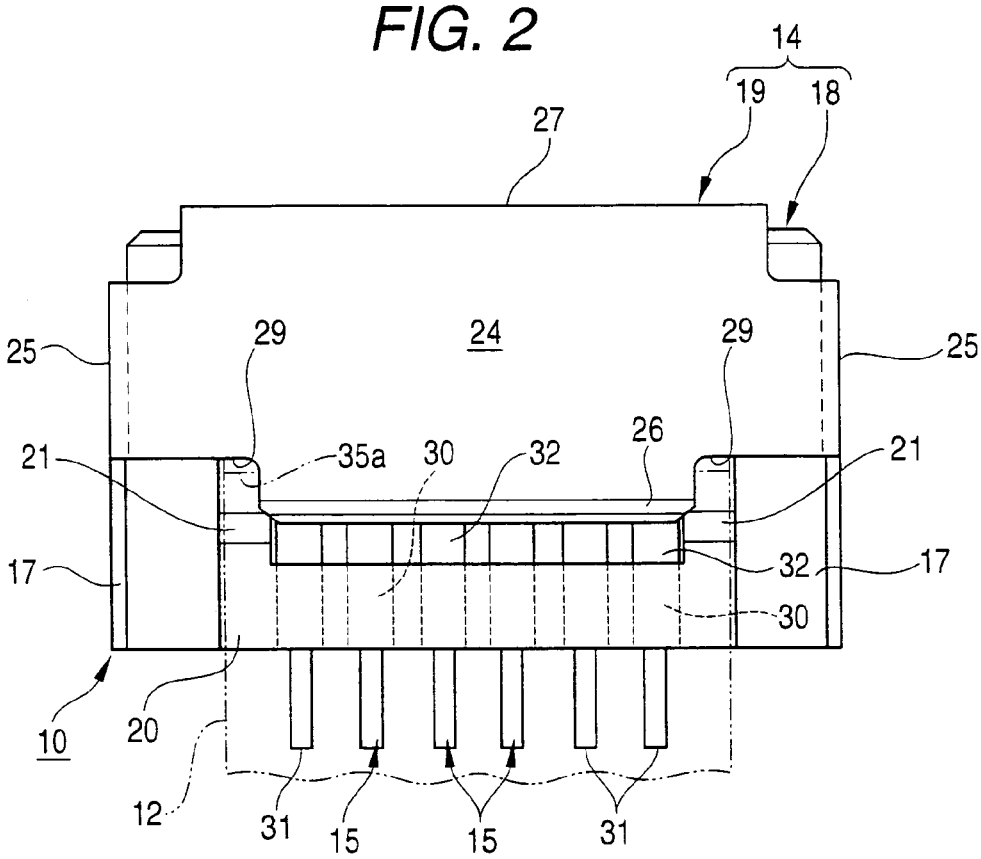
FIG. 2 is a plan view of the connector of FIG. 1.
Figure 3:
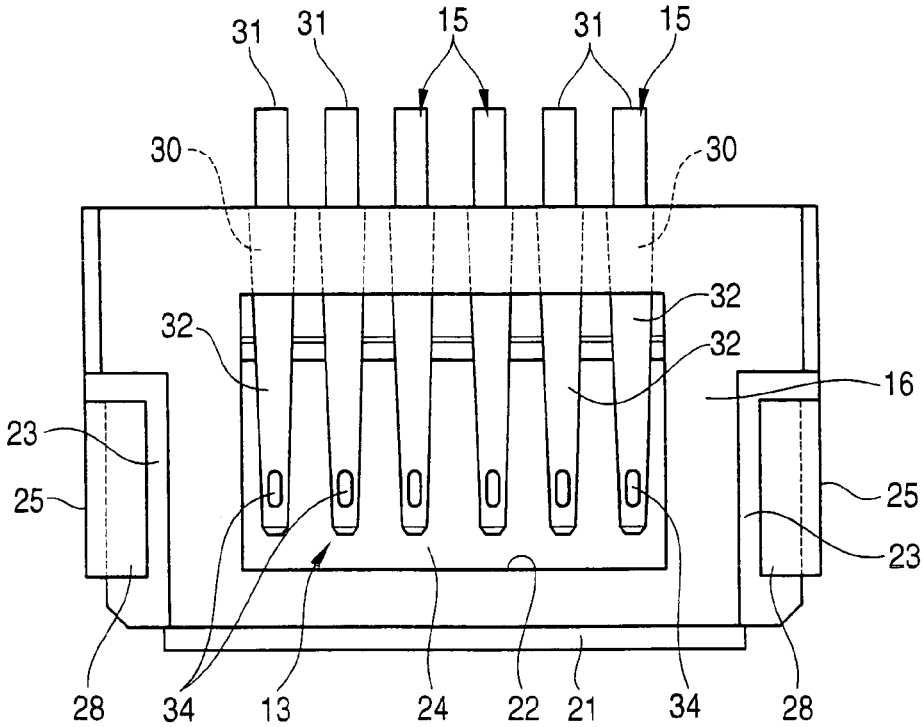
FIG. 3 is a bottom plan view of the connector of FIG. 1.
Figure 4:
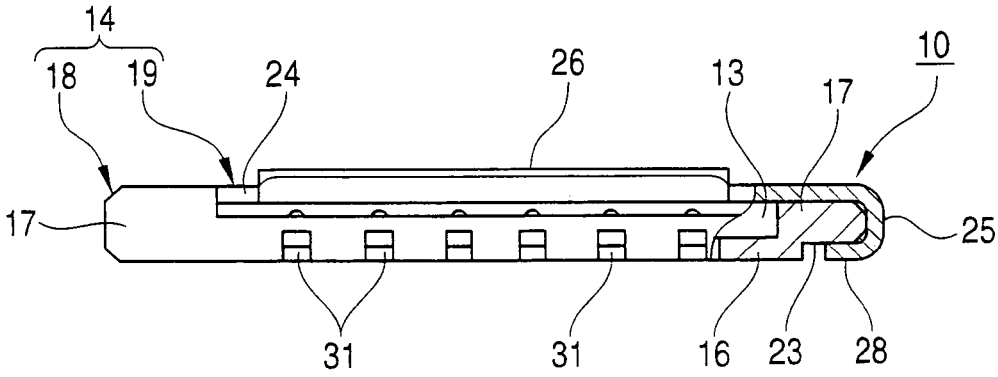
FIG. 4 is a partial cross-sectional elevational view of the connector of FIG. 1.

As shown in FIGS. 2 to 4, the connector 10 comprises a housing 14 that includes a board insertion portion 13 into which the flexible board 12 is inserted, and a plurality of contacts 15 that is held in the housing 14. The flexible board 12 that is inserted into the board insertion portion 13 is electrically connected to the connected board 11 through the contacts 15.

The housing 14 is formed with a bottom board 16, side wall portions 17 that are disposed at a periphery of the bottom board 16, that is at opposite sides and a back of the bottom board 16 in a insertion direction of the flexible board 12, and a top board that is opposed to the bottom board 16 through the wall portions 17. A housing body 18 made of synthetic resin material or the like is integrally formed with the bottom board 16 and the wall portions 17, and the top board of the housing 14 is formed from a board receiving plate 19 made of metal.

The housing 14 is formed with a board insertion portion 13 that opens to a side surface of the housing 14, that is to a front side of the housing 14 in the insertion direction in a laterally extending manner, and is disposed between the bottom board 16 and the top board. The flexible board 12 is to be inserted into the board insertion portion 13 through the opening portion.

The housing body 18 is formed in such a shape that the wall portions 17 stand at the opposite edges and the back edge of the bottom board 16.

The bottom board 16 is formed with a step portion 20 that is disposed at an upper surface of the front side of the bottom board 16 in the insertion direction, so that the upper surface of the bottom board 16 has a stepped shape. The step portion 20 is continued to the other upper surface of the bottom board 16, that is an inner bottom surface of the board insertion portion 13 through inclination portions 21 that are provided at the opposite sides of the bottom board 16.

The step portion 20 is larger than the other portion of the bottom board 16 in thickness, so that height of the step portion 20 is larger than that of the bottom surface of the board insertion portion 13.

The contacts 15 are held at the step portion 20.

The bottom board 16 is formed with a contact retracted hole 22 that is disposed at a center portion of the bottom board 16. An end surface of the step portion 20 is exposed to an inner edge of the contact retracted hole 22.

Locking concave portions 23 for fixing the board receiving plate 19 to the housing body 18 is formed at the opposite sides of a bottom of the housing body 18.

The board receiving plate 19 is integrally formed with a flat top plate portion 24, fixing pieces 25 that are disposed at opposite edges of the top plate portion 24, an introduction piece portion 26 that is formed by bending at an edge portion of the top plate portion 24 and is positioned at the opening portion of the housing 14, and a reinforcement piece 27 that is formed by bending at an edge portion of the top plate portion 24, which is opposed to the opening portion of the housing 14. The board receiving plate 19 is formed from a metallic plate member by bending process.

The fixing pieces 25 are bent downward at the opposite edges of the top plate portion 24 and the distal ends thereof are further bent inwardly to form a fixing portion 28, thereby the fixing pieces 25 have substantially L-shaped.

The fixing portions 28 are locked at the bottom of the housing body 18, that is at the locking concave portions 23, and opposite side portions of the housing body 18 are held between the top plate portion 24 and the fixing portions 28, so that the board receiving plate 19 is fixed to the housing body 18.

The fixing portions 28 are fixed to fixing patterns 11*b* formed on the connected board 11 by soldering, respectively. Assuming that the fixing patterns 11*b* are grounded, the board receiving plate 19 obtains a high shield effect because the board receiving plate 19 is formed with a metric board having high shield property.

The introduction piece portion 26 is bent so as to be substantially parallel to the inclination portions 21, and width thereof is smaller than that of the board insertion portion 13 slightly. When the board receiving plate 19 is fixed to the housing body 18, insertion confirmation gaps 29 are provided at opposite sides of the introduction piece portion 26 in the insertion direction by using an attracting portion and a relief portion arising at the time of forming the metric board receiving plate 19.

The board receiving plate 19 is mounted on the housing body 18, so that an outside surface of the wall portions 17 positioned at the back side of the housing body 18 is covered with the reinforcement piece 27 of the board receiving plate 19.

The board receiving plate 19 holds the opposite side portions of the housing body 18 by the fixing pieces 25. Therefore, even if the board receiving plate 19 is stressed, the board receiving plate 19 is not unfastened from the housing body 18. Furthermore, the introduction piece portion 26 and the reinforcement piece 27 are respectively provided with the edge portions of the board receiving plate 19, so that the board receiving plate 19 is reinforced and arched deformation of the top plate portion 24 is prevented.

Each contact 15 comprises a mounting piece portion 30 that is held in the housing 14, a terminal piece portion 31 that is supported to one end portion of the mounting piece portion 30, and a resilient contact piece portion 32 is supported to the other end portion of the mounting piece portion 30 in an obliquely upward-manner. The contacts 15 are formed by stamping the predetermined shape from the conductive plate member made of copper alloy and by bending process.

The mounting portion 30 is held by the step portion 20 of the bottom board 16 thereby fixing to the housing 14. The terminal piece portion 31 outwardly projects from the opening portion of the housing 14. The resilient contact piece portion 32 projects from the inner edge of the contact retracted hole 22, positioned at the step portion 20, into the board insertion portion 13.

The resilient contact piece portion 32 is integrally formed with the mounting piece portion 30 in an obliquely upward manner through a bending portion 33 that is integrally formed at an end portion of the mounting piece portion 30 in an obliquely downward manner. A contact portion 34 being adapted to contact with the terminal portion of the flexible board 12 is formed at a distal end portion of the resilient contact piece portion 32.

Figure 5:
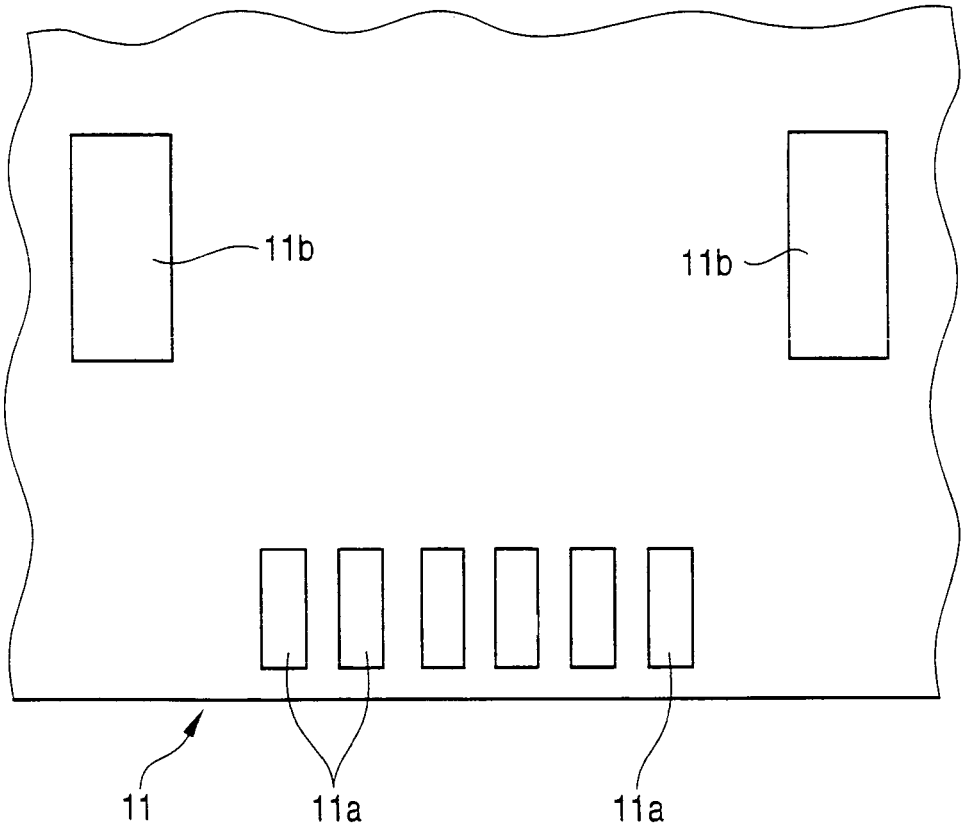
FIG. 5 is a plan view of a mounted board in FIG. 1.

As shown in FIG. 5, a printed circuit board such as PCB is employed as the connected board 11. Printed connecting terminals 11*a* to which the terminal piece portions 31 of the contacts 15 are connected by soldering or the like, are arranged on an upper surface of the connected board 11 in a parallel manner. The fixing patterns 11*b* to which the fixing portions 28 are fixed by soldering are also arranged on the upper surface of the connected board 11.

Figure 6A:
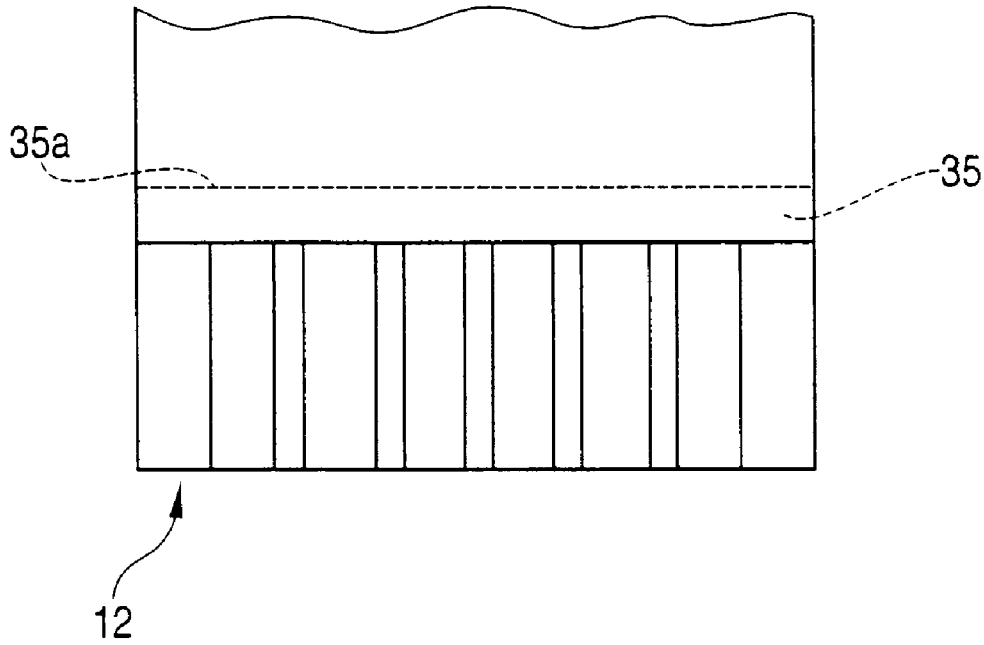
FIG. 6A is a plan view of the flexible board in FIG. 1.
Figure 6B:
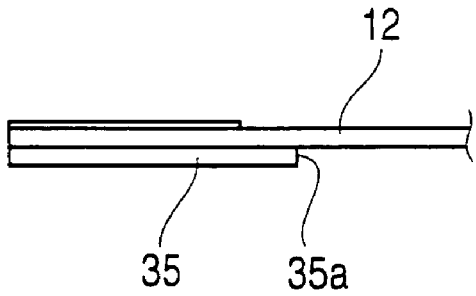
FIG. 6B is a side elevational view of the flexible board in FIG. 1.
Figure 7:
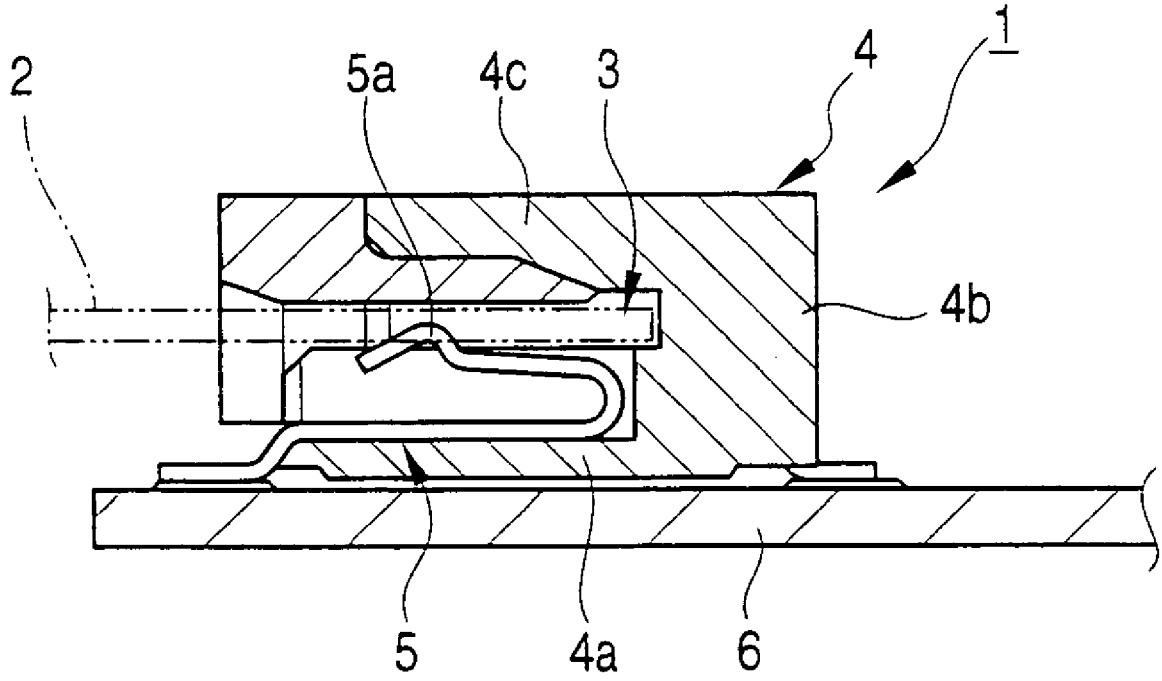
FIG. 7 is a cross-sectional view of an example of a related connector for a flexible board.

As shown in FIG. 6, a reinforcement plate 35 is integrally superposed on a surface of the flexible board 12 opposed to a surface of the flexible board 12 on which the terminal portions are formed.

Length of the reinforcement plate 35 in the insertion direction is shorter than depth of the insertion portion 13. When the flexible board 12 is sufficiently inserted into the board insertion portion 13, a basal side edge 35*a* of the reinforcement plate 35 is inserted deeper than the edge portion of the board receiving plate 19 that is positioned at the opening portion of the housing 14, so that the flexible board 12 can not viewed with eyes through the insertion confirmation gaps 29. While, when the flexible board 12 is not sufficiently inserted into the board insertion portion 13, the basal side edge 35*a* of the reinforcement plate 35 is viewed with eyes through the insertion confirmation gaps 29.

In the connector 10 described above, the flexible board 12 is inserted into the board insertion portion 13 from the opening portion of the housing 14 to a predetermined position along the inclination portions 21 of the bottom board 16 and the introduction piece portion 26, so that the resilient contact piece portions 32 projecting into the board insertion portion 13 is resiliently contacted with the terminal portions of the flexible board 12, and the flexible board 12 is held between the resilient contact piece portions 32 and the top board of the housing 14, that is the board receiving plate 19.

As described above, the flexible board 12 is contacted with the contacts 15, so that elastic force of the resilient contact piece portions 32 is operated to the top board through the flexible board 12. However, in the connector 10, since the top board formed from the board receiving plate 19 made of metal, the housing body is held by the fixing pieces 25, the board receiving plate 19 is not unfastened from the housing body 18. Furthermore, the introduction piece portion 26 and the reinforcement piece 27 are respectively formed with the edge portions of the board receiving plate 19, so that the board receiving plate 19 is reinforced, therefore the deformation of the top plate portion 24 in an arc shape is prevented and the connection between the flexible board 12 and the contacts 15 is suitably maintained.

Since the bottom board 16 is provided with the step portion 20, the flexible board 12 can be inserted into the board insertion portion 13 in a bending manner, while when the flexible board 12 is removed from the board insertion portion 13, the flexible board 12 is not removed easily because resistance to force in the removing direction of the flexible board 12 is operated.

What is claimed is:

1. A connector for connecting a flexible board to a connected board comprising:

a housing including a bottom board, side walls standing at opposite ends of the bottom board, a back wall standing at a back end of the bottom board perpendicular to the side walls, and a board receiving plate that is made of metal and is opposed to the bottom board through the side walls and the back wall;

a board insertion portion disposed in the housing and opening to a front side portion of the housing that is opposed to the back wall in a laterally extending manner;

a plurality of contacts each of which is integrally formed with a mounting piece portion that is held in the housing, and a resilient contact piece portion that is supported to an end portion of the mounting piece portion and projects into the board insertion portion from an inner edge portion positioned at the bottom board, wherein when the flexible board is inserted into the board insertion portion, the resilient contact portion is resiliently contacted with the flexible board and the flexible board is held between the board receiving plate and the resilient contact portion, wherein the bottom board includes an upper surface that faces to the board insertion portion, a step portion that is disposed on the front side portion, and inclination portions that are disposed at opposite sides of the bottom board in an insertion direction of the flexible board, and wherein the step portion is continued to the upper surface through the inclination portions, and the board receiving plate is integrally formed with an introduction piece portion that is disposed at a front edge of the board receiving plate positioned at the front side portion in an obliquely upward manner.

2. A connector according to claim 1, wherein the board receiving plate is integrally formed with fixing pieces that are disposed at opposite ends of the board receiving plate in the insertion direction of the flexible board, and the fixing pieces are locked at a bottom portion of the housing and are fixed to fixing patterns formed on the connected board.

3. A connector according to claim 1, wherein the housing includes insertion confirmation gaps that are disposed at opposite sides of the introduction piece portion in the insertion direction.

4. A connector according to claim 1, wherein the board receiving plate is formed with a reinforcement piece that is bent at a back edge of the board receiving plate opposed to the front side portion of the housing.

5. A connector according to claim 1, wherein the flexible board is integrally superposed with a reinforcement plate that is disposed on an upper surface of the flexible board facing to the board receiving plate.

6. A connector for connecting a flexible board to a connected board comprising:

a housing body made of synthetic resin and comprising a bottom board, side walls standing at opposite ends of the bottom board, and a back wall standing at a back end of the bottom board perpendicular to the side walls, the housing body being adapted to hold the flexible board;

a board receiving plate made of metal and mounted on the housing body, the board receiving plate being opposed to the bottom board through the side walls and the back wall; and a contact held in the housing body and adapted to be contacted with the flexible board, wherein when the flexible board is inserted into the housing body, the contact is contacted with the flexible board and the flexible board is held between the board receiving plate and the contact, wherein the bottom board includes an upper surface, a step portion that is disposed on a front side portion of the housing body opposed to the back wall, and inclination portions that are disposed at opposite sides of the bottom board in an insertion direction of the flexible board, and wherein the step portion is continued to the upper surface through the inclination portions.

7. A connector according to claim 6, wherein a plurality of the contacts are held in the housing body and are adapted to be contact with the flexible board.

8. A connector according to claim 6, wherein the contact is integrally formed with a mounting piece portion that is held in the housing body and a resilient contact piece portion that projects into the housing body so as to be contacted with the flexible board.

9. A connector according to claim 6, wherein the board receiving plate is integrally formed with fixing pieces that are disposed at opposite ends of the board receiving plate in the insertion direction of the flexible board, and the fixing pieces are locked at a bottom portion of the housing body and are fixed to fixing patterns formed on the connected board.

10. A connector according to claim 6, wherein the board receiving plate is integrally formed with an introduction piece portion that is disposed at a front edge of the board receiving plate opposed to the back wall in an obliquely upward manner.

11. A connector according to claim 10, wherein the housing body includes insertion confirmation gaps that are disposed at opposite sides of the introduction piece portion in the insertion direction of the flexible board.

12. A connector according to claim 6, wherein the board receiving plate is formed with a reinforcement piece that is bent at a back edge of the board receiving plate according to the back wall.

13. A connector according to claim 6, wherein the flexible board is integrally superposed with a reinforcement plate that is disposed on an upper surface of the flexible board facing to the board receiving plate.

* * * * *